United States Patent [19]

Mykkanen

[11] Patent Number: 4,649,634

[45] Date of Patent: Mar. 17, 1987

[54] HAND TOOL

[75] Inventor: C. Fred Mykkanen, Minneapolis, Minn.

[73] Assignee: Honeywell Inc., Minneapolis, Minn.

[21] Appl. No.: 751,166

[22] Filed: Jul. 2, 1985

[51] Int. Cl.[4] ..... H01R 43/00

[52] U.S. Cl. ..... 29/751; 29/268; 29/758; 81/426.5

[58] Field of Search ..... 29/751, 268, 270, 758; 227/15, 31; 81/426.5, 424.5, 426, 418

[56] References Cited

U.S. PATENT DOCUMENTS

| | | | |
|---|---|---|---|
| 2,335,580 | 11/1943 | Chirelstein | 29/751 |
| 3,398,445 | 8/1968 | Westendorf et al. | 29/758 |
| 4,017,958 | 4/1977 | Diggs | 29/268 |

*Primary Examiner*—Carl E. Hall

*Attorney, Agent, or Firm*—Roger W. Jensen

[57] ABSTRACT

A hand tool for installing a discharge pin transversely in an insulated wire having a highly stranded central conductor.

1 Claim, 4 Drawing Figures

HAND TOOL

FIELD OF THE INVENTION

This invention relates to the field of electrical technology, and particularly to apparatus for inserting discharge pins into ion discharge lines.

BACKGROUND OF THE INVENTION

In my prior U.S. Pat. No. 4,476,514, it has been pointed out that numerous advantages accrue from the discharge of ions into the atmosphere of certain spaces, such as work rooms where integrated circuit chips are being handled. As taught in that patent, ion discharge lines may be obtained in bulk from manufacturers, complete with pointed ion discharge pins (also known as emitter pins) inserted at properly spaced intervals, and for original installations this is a very satisfactory arrangement.

However, it occasionally arises that reorganization in a facility requires the rearrangement of conductors, or the installation of short extensions, or the like, where the length of new conductors is too small to comprise a feasible order from the manufacturer.

It also occasionally arises that over periods of use, the ion discharge erodes the pins so that they loose their sharp points, and pin replacement is necessary, although an installation may be otherwise quite satisfactory.

BRIEF DESCRIPTION OF THE INVENTION

The present invention comprises a tool whereby the necessary discharge pins may be inserted into electrical conductors in small quantity, at the location of intended use or limited new production and prototyping. The tool may be also used where replacement of eroded discharge pins is necessary.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals refer to corresponding parts throughout the several figures.

DESCRIPTION OF THE PREFERRED EMBODIMENT

Figure 1:
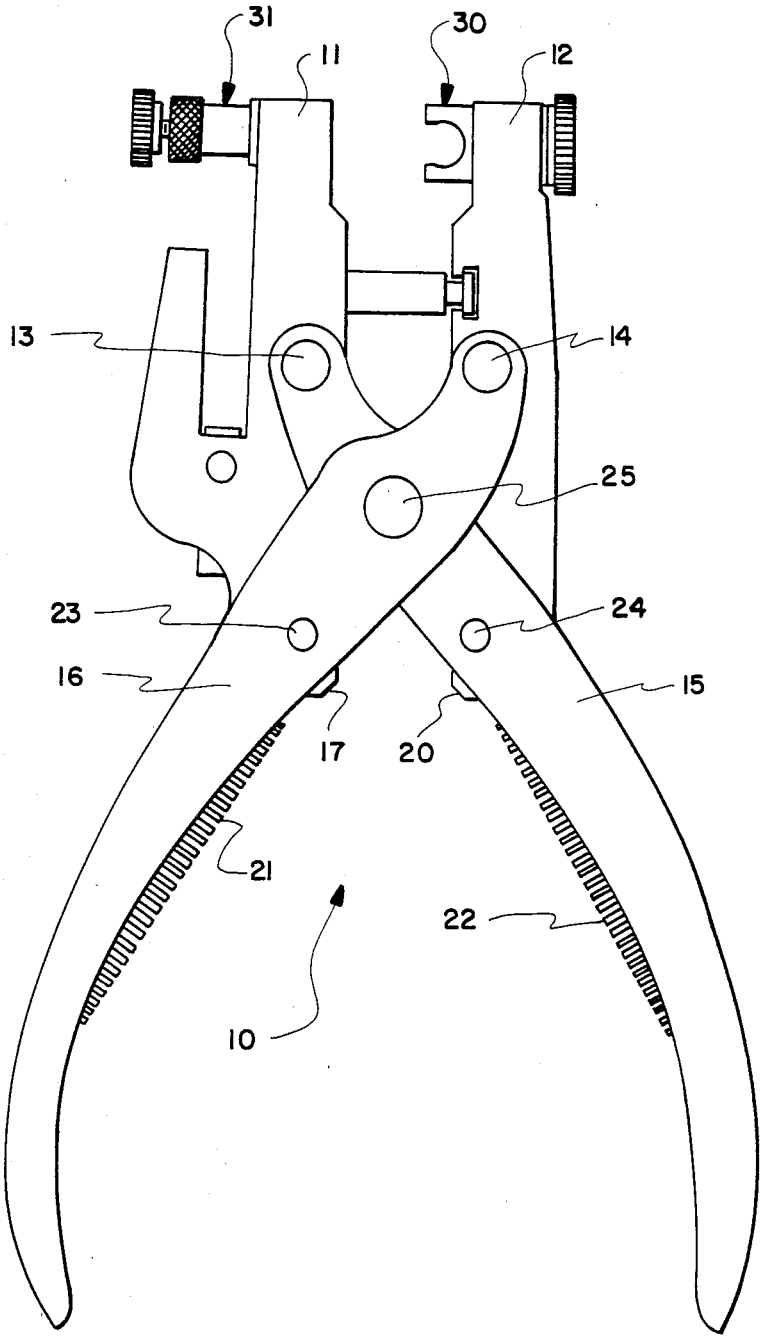
FIG. 1 is a view in elevation of a tool according to the invention.

As shown in FIG. 1, a tool 10 according to the invention comprises a modification of a "parallel action" eyelet punch of well-known construction. A pair of parallel jaws 11 and 12 are connected at pivots 13 and 14 to a pair of handles 15 and 16, the inner ends 17 and 20 of the jaws being connected to handles 16 and 15 by springs 21 and 22, all respectively. A guide pin 23 passing through handle 16 rides in a guide slot not shown in jaw 11, and a similar guide pin 24 passes through handle 15 and rides in the guide slot in jaw 12 parallel to slot 23.

Handles 15 and 16 are pivotaly interconnected at 25, and pivotal actuation of the handles causes jaws 11 and 12 to approach one another while remaining parallel, and without any angular or longitudinal relative motion.

Figure 2:
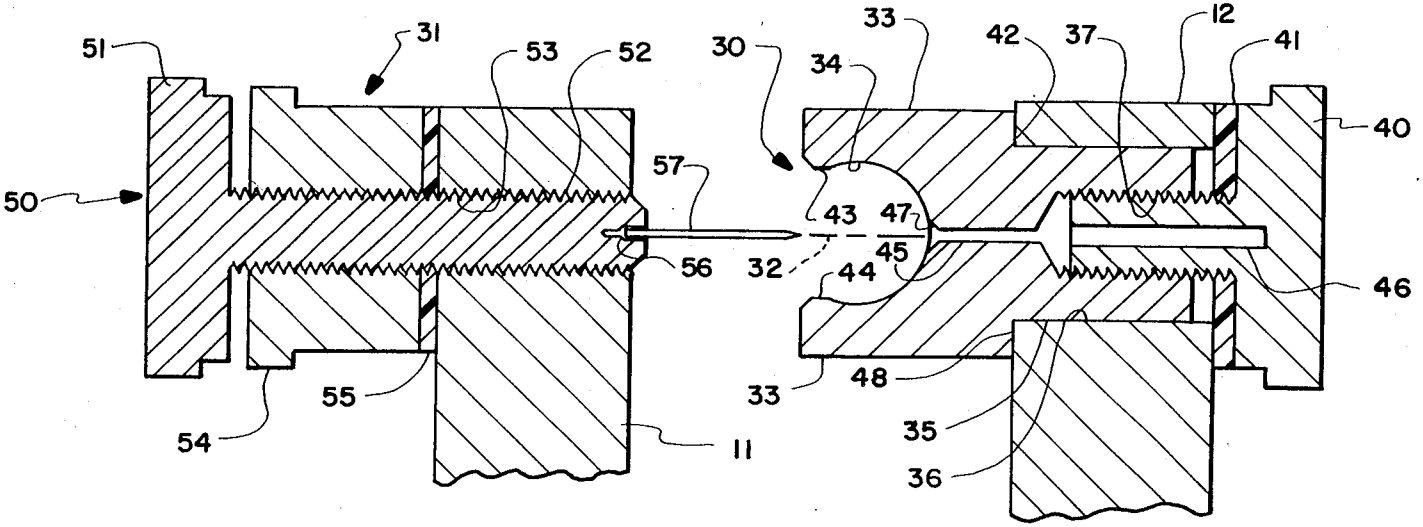
FIG. 2 is a sectional view to a larger scale of a portion of FIG. 1, and FIGS. 3 and 4 show the use of this tool.

A die assembly 30 is mounted near the end of jaw 12, and a socket assembly 31 is mounted near the end of jaw 11, to have a common axis 32 as shown in FIG. 2. Die assembly 30 comprises an enlarged head 33 formed with a transverse cradle 34, and a shank 35 fitting in an aperture 36 in jaw 12, and internally threaded at 37 to receive a thumb screw 40 carrying a washer 41. When screw 40 is tightened, a shoulder 42 of head 33 is drawn against jaw 12 to hold assembly 30 in place.

Cradle 34 is generally in the form of a semicylinder the size of the wire used in the discharge system, with two slightly over hanging lips 43 and 44 such that a wire may be laterally "snapped" into the cradle and is maintained there by the lips. A guide bore 45 passes through shank 35 axially and is aligned with a relief bore 46 in thumb screw 40: bore 45 is of slightly greater diameter than the discharge pins to be used, and its opening 47 into cradle 34 is conically enlarged.

Socket assembly 31 comprises a thumb screw 50 having an enlarged head 51 and a shank 52 externally threaded to fit a tapped opening 53 in jaw 11 coaxial with axis 32. Shank 52 carries a lock nut 54 and washer 55 to enable fixing the adjustment of screw 50 in jaw 11. The end of shank 52 is provided with a stepped bore 56 to snugly receive a discharge or emitter pin 57 and hold it substantially aligned with axis 32.

Discharge pins are of two types, single-pointed and double-pointed. To withstand the erosive effects of continued ion discharge, they must be made either of platinum or tungsten, choice of the latter being dictated by relative cost. Because of their extreme hardness, tungsten pins must be pointed using a diamond grinding wheel: since they are very small—about 9/32 inch long by 1/32 inch in diameter—the machining of the points on these pins is no easy matter. Single pointed pins are thus considerably less expensive than double pointed pins, and are generally used by the supplier for initial high volume production installation. My tool, however, can be used with either double-pointed or single-pointed pins: For the latter, a two-step procedure is required, so the former are preferable.

OPERATION

Figure 3:
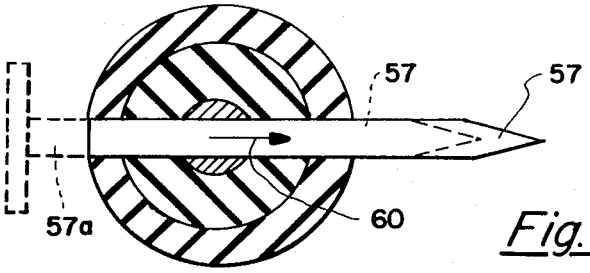

The use of the tool with a single-pointed pin will be described first. When the desired location of a pin along a conductor is determined, the insulated wire conductor is snapped into cradle 34 at that location. Set screw 51 is adjusted so that the end of socket 56 just engages the surface of the wire insulation in cradle 34 when jaw 11 engages die head 33. A pin 57 is manually inserted into bore 56, with its unpointed end bearing against the step in the bore. Now when the jaws of the tool are closed, pin 57 is forced in the direction of arrow 60 through the insulation of the conductor and through the highly stranded wire core to the position shown in dotted lines in FIG. 3. When the tool is released, the portion **57*a* of the pin which had been held in bore 56 remains outside the conductor. To complete the insertion, a metal shim is placed against end 57*a* and the jaws are again closed. The pin is no forced into its final position shown in solid lines in FIG. 3, a portion of the pin being accomodated in guide bore 45 of die 30**. The procedure is thus a two-step process.

Figure 4:
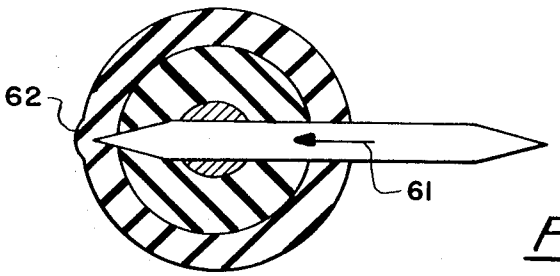

When double-point pins are used, a single step process is followed, as shown in FIG. 4. The pin is inserted manually into the bore 56 so that its shoulder engages the conical concentric surface of one point, while the tip is free. Now when the jaws are closed, the pin is forced in the direction of arrow 61 through the wire, until it nears the opposite surface, forming a bulge 62, or if desired, the pin may slightly penetrate the wire insulation shown at bulge 62. When the tool is removed, the portion of the pin which had been held in bore 56 remains outside the wire, including the second point.

It will be evident that my tool can be used by workman in any location, as for example standing on a ladder, at a workbench, or on the floor. Lips 43 and 44 combine with cradle 34 to act as a "third hand" (yet they still allow the insulated captive wire to position for pin insertion by means of rotation and/or sliding), to assist the performance of the operation, holding the tool and the wire in a desired relative location while the delicate operation of inserting a pin into bore 36 is performed, preferably using a pair of tweezers or long nose pliers.

Since the double-pointed pins require only a single operation, their use is preferred where the extra cost can be tolerated, although my tool can be used with either.

From the above it will be evident that I have invented a tool for use in installing single-pointed or double-pointed discharge pins in an insulated and highly stranded conductor in a precision manner and without damage to the pin point.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. Means for passing a pin transversely through the center of an insulated wire having a stranded central conductive core, comprising, in combination:

a socket for releasably receiving a pin and directing it along an axis;

a die having a groove extending therein to receive and captively hold the wire;

means including a pair of jaws mounting said socket and said die respectively so that said axis extends transversely and centrally through said groove;

a bore in said die aligned with said axis and of greater diameter than said pin;

means for adjusting the position of said socket in one of said jaws to determine the initial position of said pin along said axis; and means for actuating said jaws to cause relative movement parallel to said axis between said socket and said die, whereby to force transversely, through the center of a wire received in said groove, a pin contained in and extending from said socket, said means comprising a pair of handles pivoted mutually and to said jaws, and a parallel action linkage connecting said handles to said jaws so that pivotal movement of said handles causes linear relative movement of said jaws into a position along said axis predetermined by contact between said jaws, whereby a pin in said socket moves along said axis for a predetermined distance.

* * * * *